US010724799B2

(12) United States Patent
Motegi

(10) Patent No.: US 10,724,799 B2
(45) Date of Patent: Jul. 28, 2020

(54) HEAT PUMP APPARATUS

(71) Applicant: Mitsubishi Electric Corporation, Tokyo (JP)

(72) Inventor: Shuji Motegi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 116 days.

(21) Appl. No.: 15/771,535

(22) PCT Filed: Mar. 16, 2016

(86) PCT No.: PCT/JP2016/058302
§ 371 (c)(1),
(2) Date: Apr. 27, 2018

(87) PCT Pub. No.: WO2017/158755
PCT Pub. Date: Sep. 21, 2017

(65) Prior Publication Data

US 2018/0347911 A1 Dec. 6, 2018

(51) Int. Cl.
*F28D 7/02* (2006.01)
*F25B 31/00* (2006.01)
(Continued)

(52) U.S. Cl.
CPC ..... *F28D 7/024* (2013.01); *F24H 4/02* (2013.01); *F25B 13/00* (2013.01); *F25B 25/005* (2013.01);
(Continued)

(58) Field of Classification Search
CPC .... F28D 7/024; F28D 1/06; F28F 9/26; F28F 2275/04; F25B 31/006; F04B 39/06
See application file for complete search history.

(56) References Cited

U.S. PATENT DOCUMENTS 4,206,805 A * 6/1980 Beckett ..... F04B 39/06 165/169
4,248,056 A * 2/1981 Beacham ..... F25B 31/006 62/238.7
(Continued)

FOREIGN PATENT DOCUMENTS

JP H04-099873 A 3/1992
JP 2006-194467 A 7/2006
(Continued)

OTHER PUBLICATIONS

International Search Report and Written Opinion of the International Searching Authority dated May 31, 2016 for the corresponding international application No. PCT/JP2016/058302 (and English translation).
(Continued)

*Primary Examiner* — Ana M Vazquez
(74) *Attorney, Agent, or Firm* — Posz Law Group, PLC

(57) ABSTRACT

A heat pump apparatus includes: a compressor including a cylindrical shell, the compressor being configured to compress a refrigerant; and a shell heat exchanger including a helical conduit wound around the outer circumference of the shell, the shell heat exchanger being configured to transfer heat of the shell to a heating medium flowing through the conduit. The shell heat exchanger includes: a plurality of segments; and joining portions configured to connect end portions of adjacent segments to each other. The segments each at least partially have an arc-like shape along the outer circumference of the shell when viewed from the axial direction of the shell. The segments are removable in the radial direction of the shell when the joining portions are separated.

9 Claims, 10 Drawing Sheets

(51) Int. Cl.

| | |
|---|---|
| ***F24H 4/02*** | (2006.01) |
| ***F28D 1/06*** | (2006.01) |
| ***F25B 39/00*** | (2006.01) |
| ***F28F 9/26*** | (2006.01) |
| ***F25B 25/00*** | (2006.01) |
| ***F25B 30/02*** | (2006.01) |
| ***F25B 13/00*** | (2006.01) |

(52) U.S. Cl.

CPC ..... *F25B 30/02* (2013.01); *F25B 31/006* (2013.01); *F25B 39/00* (2013.01); *F28D 1/06* (2013.01); *F28F 9/26* (2013.01); *F28F 2275/04* (2013.01)

(56) References Cited

U.S. PATENT DOCUMENTS

| | | | | |
|---|---|---|---|---|
| 2013/0205812 | A1 | 8/2013 | Yamashita | |
| 2014/0044569 | A1* | 2/2014 | Kremer | F04B 39/06 417/243 |

FOREIGN PATENT DOCUMENTS

| | | | |
|---|---|---|---|
| JP | 2007-155276 | A | 6/2007 |
| JP | 2009-264261 | A | 11/2009 |
| JP | 2010-091177 | A | 4/2010 |
| JP | 2011-149631 | A | 8/2011 |
| JP | 2011-185538 | A | 9/2011 |
| JP | 3194436 | U | 11/2014 |
| JP | 2015-092126 | | 5/2015 |
| WO | 2012/073294 | A1 | 6/2012 |

OTHER PUBLICATIONS

Office Action dated Feb. 12, 2019 issued in corresponding JP patent application No. 2018-505132 (and English translation).

* cited by examiner

HEAT PUMP APPARATUS

CROSS REFERENCE TO RELATED APPLICATION

This application is a U.S. national stage application of PCT/JP2016/058302 filed on Mar. 16, 2016, the contents of which are incorporated herein by reference.

TECHNICAL FIELD

The present invention relates to a heat pump apparatus.

BACKGROUND ART

A heat pump apparatus as below is disclosed in FIG. 14 of PTL 1. A shell heat exchanger (8) that heats water is mounted on a cylindrical shell included in a compressor that compresses a refrigerant. The shell heat exchanger (8) is a jacket heat exchanger. The shell heat exchanger (8) is divided into two parts in the circumferential direction.

CITATION LIST

Patent Literature

[PTL 1] Japanese Patent Application Publication No. 2006-194467

SUMMARY OF INVENTION

Technical Problem

In the conventional heat pump apparatus described above, calcium carbonate and the like deposit from high-temperature hot water in a flow path in the shell heat exchanger (8), and adhere to the flow path as scale. The shell heat exchanger (8) needs to be replaced when the flow path becomes narrower due to the accumulation of the scale. The work cost of the replacement can be reduced by dividing the shell heat exchanger (8) into two parts in the circumferential direction.

The jacket shell heat exchanger (8) includes a member obtained by combining sheet metals. A combination of high-precision bending of sheet metal parts is needed in order to form the member obtained by combining sheet metals, and hence the parts manufacturing cost significantly increases. As described above, the manufacturing cost of the shell heat exchanger (8) is high in the conventional heat pump apparatus described above.

The present invention has been made in order to solve the problem as described above, and an object thereof is to provide a heat pump apparatus capable of reducing the work cost when a shell heat exchanger that transfers heat of a shell of a compressor to a heating medium is replaced, and capable of reducing the manufacturing cost of the shell heat exchanger.

Solution to Problem

A heat pump apparatus according to the present invention includes: a compressor including a cylindrical shell, the compressor being configured to compress a refrigerant; and a shell heat exchanger including a helical conduit wound around an outer circumference of the shell, the shell heat exchanger being configured to transfer heat of the shell to a heating medium flowing through the conduit. The shell heat exchanger includes: a plurality of segments; and joining portions configured to connect end portions of adjacent segments. The segments each at least partially have an arc-like shape along the outer circumference of the shell when viewed from an axial direction of the shell. The segments are removable in a radial direction of the shell when the joining portions are separated.

Advantageous Effects of Invention

According to the heat pump apparatus of the present invention, the work cost when the shell heat exchanger that transfers the heat of the shell of the compressor to the heating medium is replaced can be reduced, and the manufacturing cost of the shell heat exchanger can be reduced.

DESCRIPTION OF EMBODIMENTS

Figure 1:
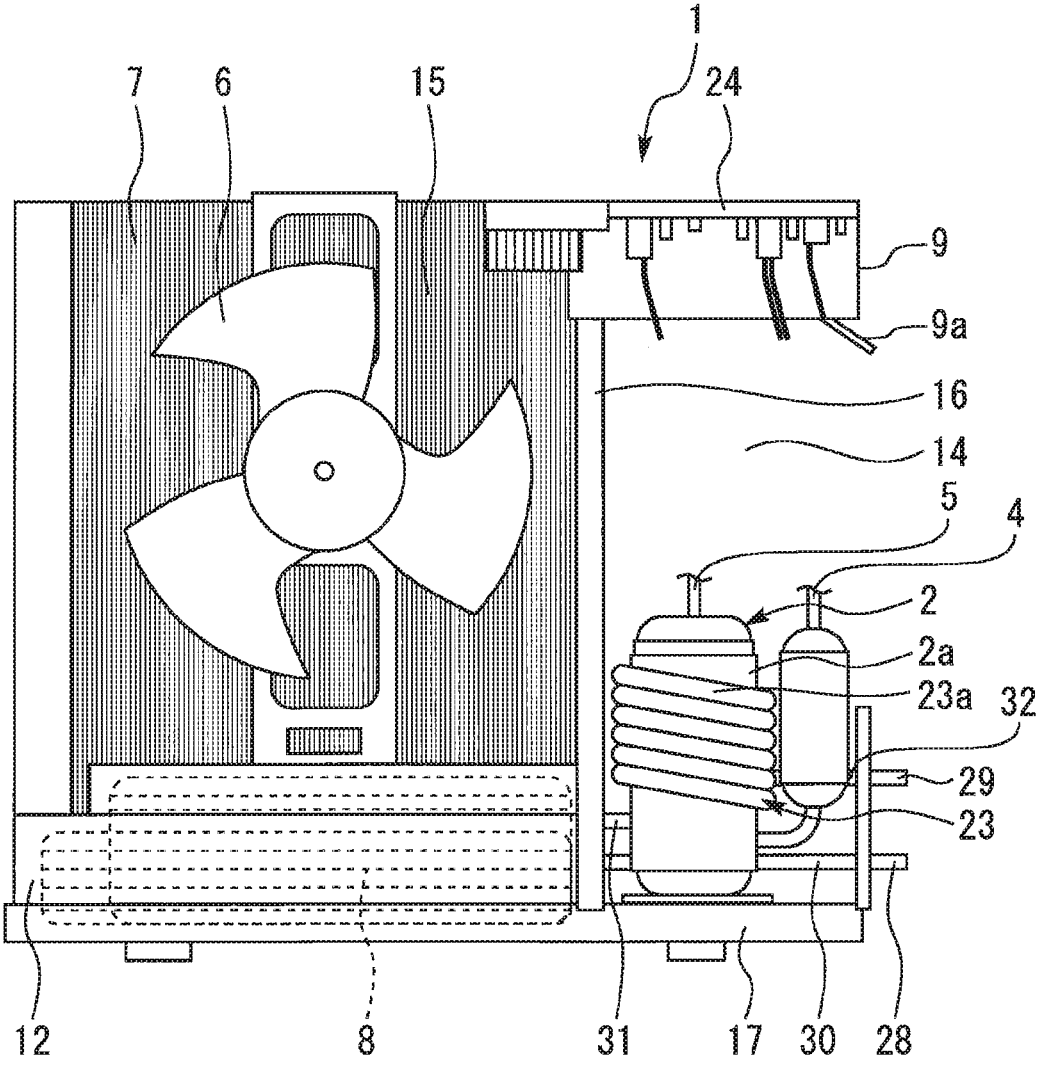
FIG. 1 is a front view illustrating the internal structure of a heat pump apparatus 1 of Embodiment 1.

Embodiments are described below with reference to the drawings. Common elements in the drawings are denoted by the same symbols, and overlapping descriptions are simplified or omitted.

This disclosure may include all the combinations of the combinable configurations out of the configurations to be described in the embodiments below.

Embodiment 1

Figure 2:
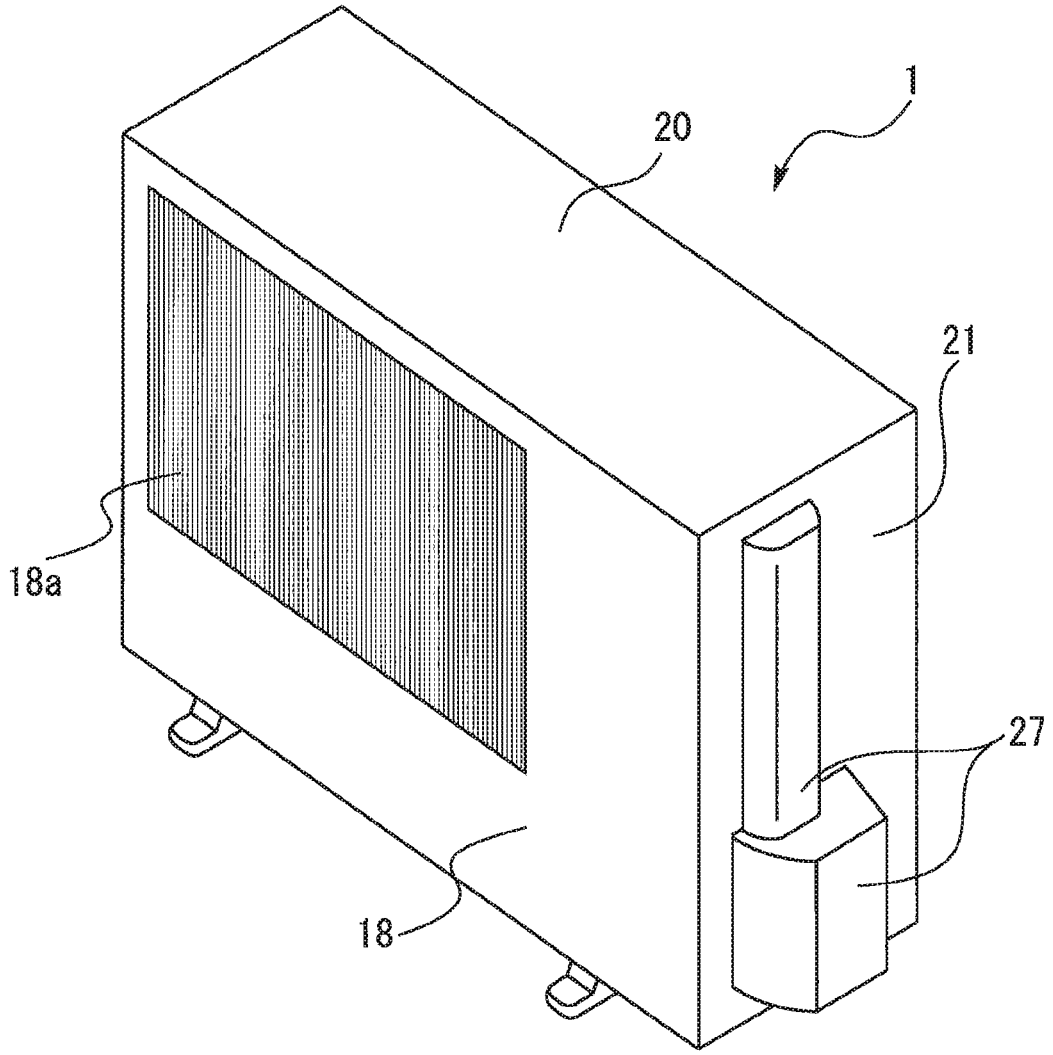
FIG. 2 is a perspective view of the heat pump apparatus 1 of Embodiment 1 viewed obliquely from the front side thereof.
Figure 3:
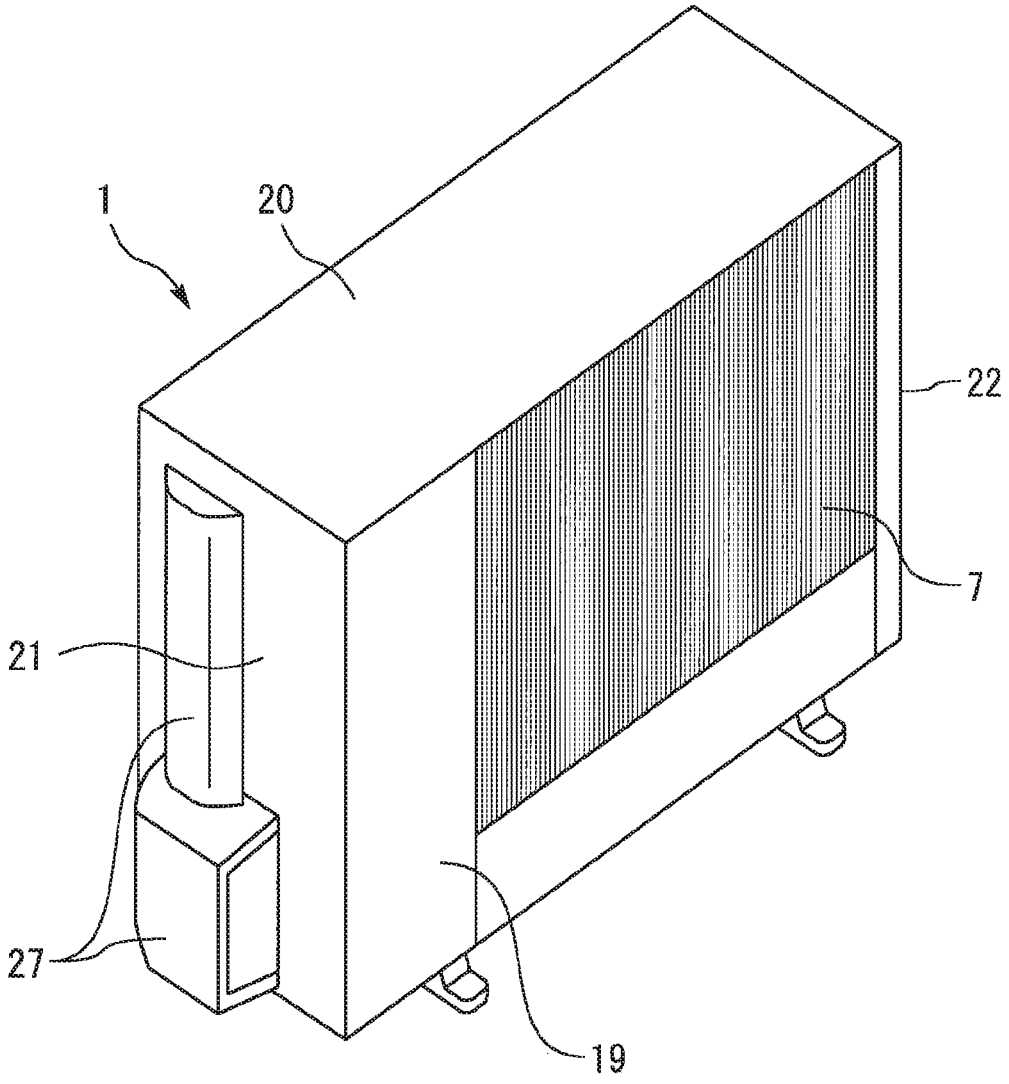
FIG. 3 is a perspective view of the heat pump apparatus 1 of Embodiment 1 viewed obliquely from the rear side thereof.
Figure 4:
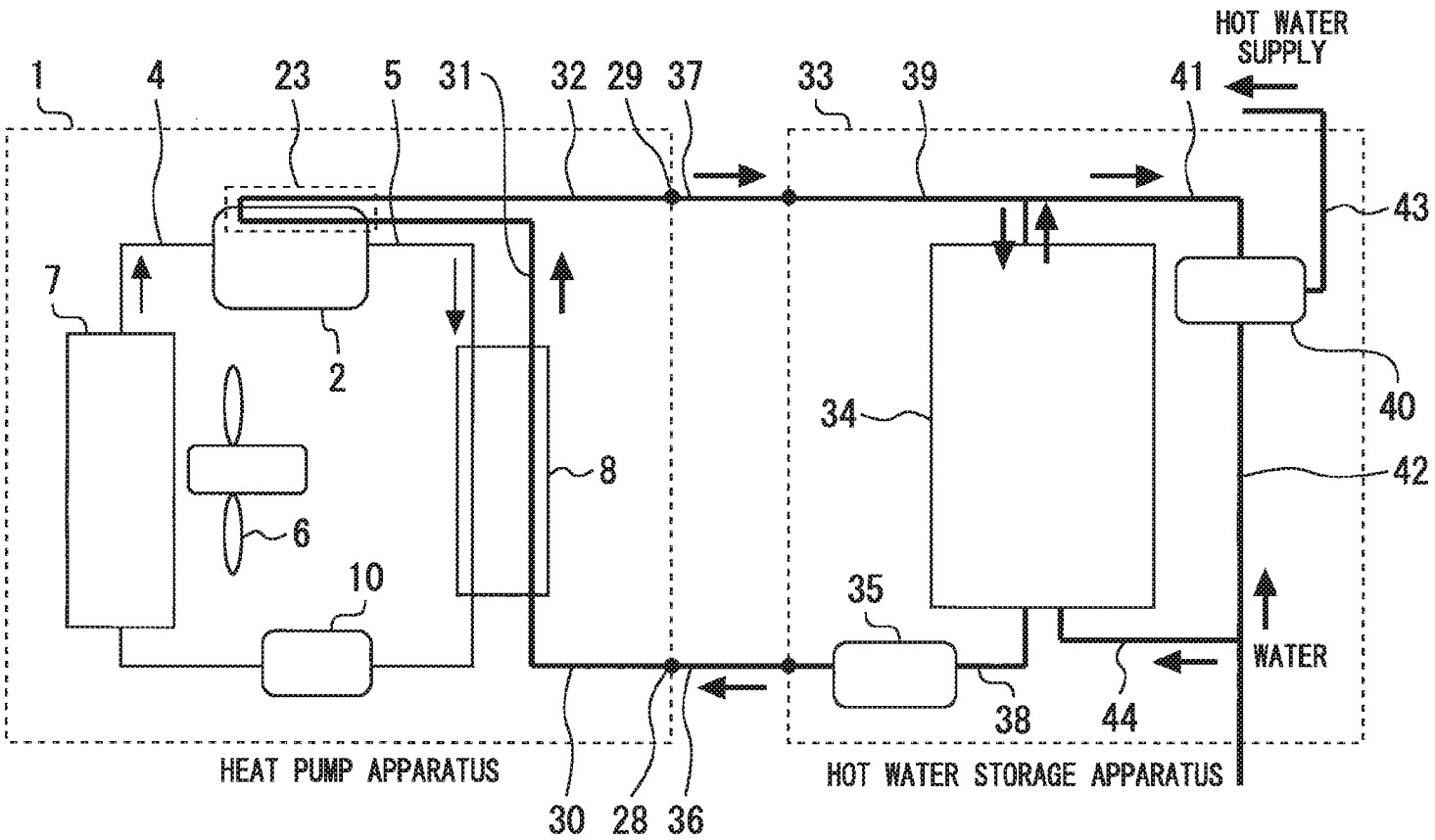
FIG. 4 is a view illustrating a refrigerant circuit and a water circuit of a heat pump hot water supply system including the heat pump apparatus 1 of Embodiment 1.

FIG. 1 is a front view illustrating the internal structure of a heat pump apparatus 1 of Embodiment 1. FIG. 2 is a perspective view of the heat pump apparatus 1 of Embodiment 1 viewed obliquely from the front side thereof. FIG. 3 is a perspective view of the heat pump apparatus 1 of Embodiment 1 viewed obliquely from the rear side thereof. FIG. 4 is a view illustrating a refrigerant circuit and a water circuit of a heat pump hot water supply system including the heat pump apparatus 1 of Embodiment 1.

The heat pump apparatus 1 of this embodiment is installed outdoors. The heat pump apparatus 1 heats a liquid heating medium. The heating medium of this embodiment is water. The heat pump apparatus 1 heats the water and generates hot water. The heating medium in the present invention may be brine other than water such as calcium chloride solution, ethylene glycol solution, and alcohol.

As illustrated in FIG. 1, the heat pump apparatus 1 has a base 17 forming the bottom of a casing. On the base 17, a machine room 14 is formed on the right side and a fan chamber 15 is formed on the left side when viewed from the front side. The machine room 14 and the fan chamber 15 are separated from each other by a partition plate 16. As illustrated in FIG. 2 and FIG. 3, the casing forming the enclosure of the heat pump apparatus 1 further includes a casing front-surface portion 18, a casing rear-surface portion 19, a casing upper-surface portion 20, a casing right side-surface portion 21, and a casing left side-surface portion 22. Those components of the casing are molded from sheet metal materials, for example. The exterior surface of the heat pump apparatus 1 is covered by this casing except for an air/refrigerant heat exchanger 7 disposed on the rear-surface side. An opening that exhausts air that has flowed through the fan chamber 15 is formed in the casing front-surface portion 18, and a grating 18*a* is attached to this opening. FIG. 1 illustrates a state in which the parts of the casing besides the base 17 are removed. The illustration of some consisting machines is omitted in FIG. 1.

As illustrated in FIG. 1, a compressor 2 that compresses the refrigerant, an expansion valve 10 (not shown in FIG. 1) that decompresses the refrigerant, and refrigerant pipes such as a suction pipe 4 and a discharge pipe 5 that connect those components to each other are assembled in the machine room 14 as refrigerant circuit parts.

The compressor 2 includes a cylindrical shell 2*a*. The compressor 2 includes a compression unit (not shown) and a motor (not shown) in the shell 2*a*. The compression unit performs the operation of compressing the refrigerant. The motor drives the compression unit. The motor of the compressor is driven by electricity supplied from the outside. The refrigerant is sucked into the compressor 2 through the suction pipe 4. The discharge pipe 5 that discharges the refrigerant compressed in the compressor 2 is connected to upper portion of the compressor 2. The expansion valve 10 has a coil-assembled member mounted on the outer side surface of the main body thereof. A flow path resistance adjustment unit on the inside is activated and the flow path resistance of the refrigerant is adjusted by energizing the coil from the outside. The pressure of a high-pressure refrigerant on the upstream side of the expansion valve 10 and the pressure of a low-pressure refrigerant on the downstream side of the expansion valve 10 can be adjusted by the expansion valve 10. The expansion valve 10 is an example of a decompression device that decompresses the refrigerant.

The fan chamber 15 has a space larger than the machine room 14 in order to secure an air passage. A fan 6 is assembled in the fan chamber 15. The fan 6 includes two or three propeller blades and a motor that drives the propeller blades to rotate. The motor and the propeller blades are rotated by electricity supplied from the outside. The air/refrigerant heat exchanger 7 is installed on the rear-surface side of the fan chamber 15 in a manner opposed to the fan 6. The air/refrigerant heat exchanger 7 includes a large number of fins made of aluminum sheets, and a long refrigerant pipe folded several times so as to be in close contact with the fins made of aluminum sheets a large number of times. The air/refrigerant heat exchanger 7 has a flat plate-like shape that is bended in an L shape. The air/refrigerant heat exchanger 7 is installed from the rear side to the left side surface of the heat pump apparatus 1. In the air/refrigerant heat exchanger 7, heat is exchanged between the refrigerant in the refrigerant pipe and the air surrounding the fins. The fan 6 adjusts the air flow of the air flowing through a place between the fins by increasing the air flow, and adjusts the amount of the heat exchange by increasing the amount of the heat exchange. The air/refrigerant heat exchanger 7 is an example of an evaporator that evaporates the refrigerant.

A water/refrigerant heat exchanger 8 is installed on the base 17 below the fan chamber 15. The water/refrigerant heat exchanger 8 is installed by being accommodated in a rectangular accommodation container 12 in a state of being covered by a heat insulating material. The water/refrigerant heat exchanger 8 is bonded so as to be able to be accommodated in the accommodation container 12 in a state in which a long water pipe and a long refrigerant pipe are in close contact with each other. In the water/refrigerant heat exchanger 8, heat is exchanged between the refrigerant in the refrigerant pipe and the water, that is, the heating medium in the water pipe. The water, that is, the heating medium is heated in the water/refrigerant heat exchanger 8. The fan 6 is disposed above the water/refrigerant heat exchanger 8.

A shell heat exchanger 23 is attached to the shell 2*a* of the compressor 2. The shell heat exchanger 23 includes a helical conduit 23*a* wound around the outer circumference of the shell 2*a* of the compressor 2. The conduit 23*a* is in contact with an outer circumferential surface of the shell 2*a* so that heat conduction is possible. The conduit 23*a* may be in direct contact with the outer circumferential surface of the shell 2*a*. The conduit 23*a* may be in contact with the outer circumferential surface of the shell 2*a* through a heat conductive material. The heat conductive material may be a heat conductive sheet or heat conductive grease. The shell 2*a* is filled with a high-temperature and high-pressure compressed refrigerant gas. The temperature of the shell 2*a* becomes high due to the heat of the refrigerant gas. The shell heat exchanger 23 transfers the heat of the shell 2*a* to the water, that is, the heating medium flowing through the conduit 23*a*. The water, that is, the heating medium flowing through the conduit 23*a* is heated by receiving the heat of the shell 2*a*. A heat insulating material (not shown) that at least partially covers the shell heat exchanger 23 may be included on the outer side of the shell heat exchanger 23.

An outlet of the compressor 2 is connected to a refrigerant inlet of the water/refrigerant heat exchanger 8 through the discharge pipe 5. A refrigerant outlet of the water/refrigerant heat exchanger 8 is connected to an inlet of the expansion valve 10 in the machine room 14 through the refrigerant pipe. An outlet of the expansion valve 10 is connected to a refrigerant inlet of the air/refrigerant heat exchanger 7 through the refrigerant pipe. A refrigerant outlet of the air/refrigerant heat exchanger 7 is connected to an inlet of the compressor 2 through the suction pipe 4. Other refrigerant circuit parts may be connected in the middle of the refrigerant pipe.

An electrical item accommodation box 9 is disposed above the machine room 14. The electrical item accommodation box 9 accommodates an electronic substrate 24. Electronic parts, electrical parts, and the like forming modules that drive and control the compressor 2, the expansion valve 10, the fan 6, and the like are mounted on the electronic substrate 24. The modules perform control as below, for example. The rotational speed of the motor of the compressor 2 is changed to a predetermined rotational speed of about several dozen rps (Hz) to 100 rps (Hz). The opening degree of the expansion valve 10 is changed to a predetermined amount. The rotational speed of the fan 6 is changed to a predetermined rotational speed of about several hundred rpm to 1000 rpm. A terminal block 9*a* to be connected to external electrical wiring is mounted on the electrical item accommodation box 9. As illustrated in FIG. 2 and FIG. 3, a service panel 27 that protects the terminal block 9*a*, and a water inlet valve 28 and a hot water outlet valve 29 to be described later is attached to the casing right side-surface portion 21.

A predetermined amount of refrigerant is enclosed in an enclosed space of the refrigerant circuit included in the heat pump apparatus 1. The refrigerant may be a $CO_2$ refrigerant, for example.

Now, a water circuit of the heat pump apparatus 1 and a hot water storage apparatus 33 is described. As illustrated in FIG. 1, a water circuit part including an inner pipe 30, an inner pipe 31, and an inner pipe 32 is assembled in the machine room 14. The water inlet valve 28 and the hot water outlet valve 29 are arranged together on the right side of the base 17 so that the water inlet valve 28 is on the lower side and the hot water outlet valve 29 is on the upper side. The inner pipe 30 connects the water inlet valve 28 and a water inlet of the water/refrigerant heat exchanger 8 to each other. The inner pipe 31 connects a hot water outlet of the water/refrigerant heat exchanger 8 and an inlet of the shell heat exchanger 23 to each other. The inner pipe 32 connects an outlet of the shell heat exchanger 23 and the hot water outlet valve 29 to each other.

As illustrated in FIG. 4, the heat pump hot water supply system is formed by the heat pump apparatus 1 and the hot water storage apparatus 33. The hot water storage apparatus 33 includes a hot water storage tank 34 having a capacity of about several hundred liters, for example, and a water pump 35 that sends the water in the hot water storage tank 34 to the heat pump apparatus 1. The heat pump apparatus 1 and the hot water storage apparatus 33 are connected to each other through an external pipe 36, an external pipe 37, and electrical wiring (not shown).

The lower portion of the hot water storage tank 34 is connected to an inlet of the water pump 35 through a pipe 38. The external pipe 36 connects an outlet of the water pump 35 and the water inlet valve 28 of the heat pump apparatus 1 to each other. The external pipe 37 connects the hot water outlet valve 29 of the heat pump apparatus 1 and the hot water storage apparatus 33 to each other. The external pipe 37 can communicate with the upper portion of the hot water storage tank 34 through a pipe 39 in the hot water storage apparatus 33.

The hot water storage apparatus 33 further includes a mixing valve 40. The mixing valve 40 is connected to a hot water supply pipe 41 branching off from the pipe 39, a water supply pipe 42 through which water supplied from a water source such as water supply flows, and a hot water supply pipe 43 through which hot water is supplied to the user side. The mixing valve 40 adjusts the hot water supply temperature by adjusting the mixture ratio of the hot water, that is, high-temperature water flowing from the hot water supply pipe 41 to the water, that is, low-temperature water flowing from the water supply pipe 42. The hot water mixed by the mixing valve 40 is sent to terminals on the user side such as a bathtub, a shower, a faucet, and a dishwasher through the hot water supply pipe 43. The lower portion of the hot water storage tank 34 is connected to a water supply pipe 44 branching off from the water supply pipe 42. The water flowing into the hot water storage tank 34 from the water supply pipe 44 is stored in the hot water storage tank 34 on the lower side thereof.

Now, the operation of the heat pump apparatus 1 in heat accumulating operation is described. The heat accumulating operation is an operation in which the hot water heated in the heat pump apparatus 1 is sent to the hot water storage apparatus 33 and is accumulated in the hot water storage tank 34. The heat accumulating operation is as follows. The compressor 2, the fan 6, and the water pump 35 are operated. The rotational speed of the motor of the compressor 2 can be changed within the range of about several dozen rps (Hz) to 100 rps (Hz). As a result, the heating power can be adjusted and controlled by changing the flow rate of the refrigerant.

The rotational speed of the motor of the fan 6 changes to about several hundred rpm to 1000 rpm. The heat exchange amount between the refrigerant and the air in the air/refrigerant heat exchanger 7 can be adjusted and controlled by changing the flow rate of the air flowing through the air/refrigerant heat exchanger 7. The air is sucked into the air/refrigerant heat exchanger 7 installed behind the fan 6 from a place behind the air/refrigerant heat exchanger 7, flows through the air/refrigerant heat exchanger 7, flows through the fan chamber 15, and is discharged to a place in front of the casing front-surface portion 18 on the side opposite to the air/refrigerant heat exchanger 7.

The expansion valve 10 adjusts the flow path resistivity of the refrigerant. As a result, the pressure of the high-pressure refrigerant on the upstream side of the expansion valve 10 and the low-pressure refrigerant on the downstream side of the expansion valve 10 can be adjusted and controlled. The rotational speed of the compressor 2, the rotational speed of the fan 6, and the flow path resistivity of the expansion valve 10 are controlled in accordance with the installation environment and requirements of the heat pump apparatus 1.

The low-pressure refrigerant is sucked in the compressor 2 through the suction pipe 4. The low-pressure refrigerant is compressed in the compression unit in the compressor 2, and becomes a high-temperature and high-pressure refrigerant. The high-temperature and high-pressure refrigerant is discharged from the compressor 2 to the discharge pipe 5. The high-temperature and high-pressure refrigerant flows through the discharge pipe 5, and flows into the refrigerant inlet of the water/refrigerant heat exchanger 8. The high-temperature and high-pressure refrigerant heats the water and generates hot water by exchanging heat with the water in the water/refrigerant heat exchanger 8. The refrigerant reduces the enthalpy and the temperature thereof while flowing through the water/refrigerant heat exchanger 8. The high-pressure refrigerant of which temperature is reduced flows from the refrigerant outlet of the water/refrigerant heat exchanger 8 into the inlet of the expansion valve 10 through the refrigerant pipe. By decompressing the high-pressure refrigerant to a predetermined pressure in the expansion valve 10, the temperature of the high-pressure refrigerant drops and the high-pressure refrigerant becomes a low-temperature and low-pressure refrigerant. The low-temperature and low-pressure refrigerant flows from the outlet of the expansion valve 10 into the inlet of the air/refrigerant heat exchanger 7 through the refrigerant pipe. The low-temperature and low-pressure refrigerant exchanges heat with the air in the air/refrigerant heat exchanger 7, increases the enthalpy thereof, flows from the outlet of the air/refrigerant heat exchanger 7 into the suction pipe 4, and is sucked into the compressor 2. As described above, the refrigerant circulates, and the beat pump cycle is performed.

At the same time, the water in the lower portion of the hot water storage tank 34 flows into the water inlet of the water/refrigerant heat exchanger 8 through the pipe 38, the external pipe 36, the water inlet valve 28, and the inner pipe 30 by the drive of the water pump 35. The water exchanges heat with the refrigerant in the water/refrigerant heat exchanger 8. As a result, the water is heated, and hot water is generated. The hot water flows into the inlet of the shell heat exchanger 23 through the inner pipe 31. High-temperature hot water is generated by further heating the hot water in the shell heat exchanger 23. The high-temperature hot water flows from the outlet of the shell heat exchanger 23 into the upper portion of the hot water storage tank 34 through the inner pipe 32, the hot water outlet valve 29, the external pipe 37, and the pipe 39. By performing the heat accumulating operation as above, the high-temperature hot water is accumulated in the hot water storage tank 34 from the upper portion to the lower portion thereof.

The hot water heated in the heat pump apparatus 1 may be directly supplied to the user side without being stored in the hot water storage tank 34. The heating medium heated in the heat pump apparatus 1 may be used for heating a space and the like.

According to this embodiment, the following effects can be obtained by including the shell heat exchanger 23 in the heat pump apparatus. The input of electricity to the compressor 2 can be reduced. The efficiency of the heat pump apparatus 1 increases. The rise in the temperature of refrigerator oil and the temperature of the motor in the compressor 2 can be prevented. Damage on a sliding portion in the compressor 2 and damage on a motor winding can be reliably prevented.

When the heat pump apparatus 1 is in operation, the high-temperature hot water flows in the conduit 23*a* of the shell heat exchanger 23. Scale such as calcium carbonate deposits in the conduit 23*a* from the high-temperature hot water, and adheres to the conduit 23*a*. As the scale is accumulated in the conduit 23*a* over a long period of time, the flow path in the conduit 23*a* becomes narrower, and the heating performance reduces. When such a state is reached, the shell heat exchanger 23 needs to be replaced for a new shell heat exchanger.

Figure 5:
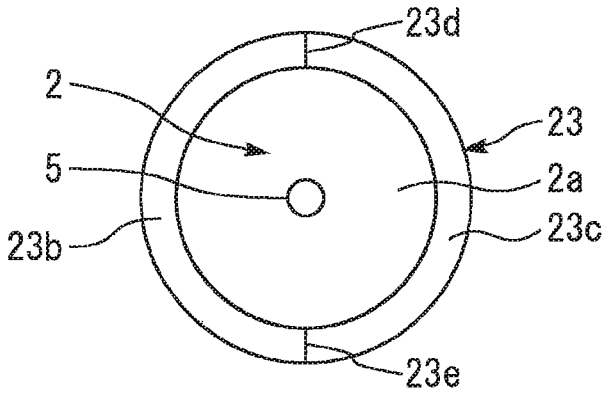
FIG. 5 is a plan view of a compressor and a shell heat exchanger included in the heat pump apparatus 1 of Embodiment 1.

FIG. 5 is a plan view of the compressor 2 and the shell heat exchanger 23 included in the heat pump apparatus 1 of Embodiment 1. FIG. 5 is a view viewed from the axial direction of the shell 2*a* of the compressor 2. As illustrated in FIG. 5, the shell heat exchanger 23 includes a first segment 23*b*, a second segment 23*c*, first joining portions 23*d*, and second joining portions 23*e*. In FIG. 5, the illustration of the inlet and the outlet of the shell heat exchanger 23 is omitted.

When viewed from the axial direction of the shell 2*a*, the shell heat exchanger 23 is as follows. The first segment 23*b* at least partially has an arc shape along the outer circumference of the shell 2*a*. The arc of the first segment 23*b* has an angle at the circumference of 180 degrees. The second segment 23*c* at least partially has an arc shape along the outer circumference of the shell 2*a*. The arc of the second segment 23*c* has an angle at the circumference of 180 degrees. The radius of curvature of the inner circumferential surface of the first segment 23*b* is substantially equal to ½ of the diameter of the shell 2*a*. The radius of curvature of the inner circumferential surface of the second segment 23*c* is substantially equal to ½ of the diameter of the shell 2*a*. The first segment 23*b* and the second segment 23*c* are adjacent to each other. The first joining portions 23*d* connect one end of the first segment 23*b* to one end of the second segment 23*c*. The second joining portions 23*e* connect the other end of the first segment 23*b* to the other end of the second segment 23*c*.

The inner circumferential surfaces of the first segment 23*b* and the second segment 23*c* are in contact with the outer circumferential surface of the shell 2*a* so that heat conduction is possible. The inner circumferential surfaces of the first segment 23*b* and the second segment 23*c* may be in direct contact with the outer circumferential surface of the shell 2*a*. The inner circumferential surfaces of the first segment 23*b* and the second segment 23*c* may be in contact with the outer circumferential surface of the shell 2*a* through a heat conductive material. The heat conductive material may be a heat conductive sheet or heat conductive grease.

The first joining portions 23*d* are joined to each other and the second joining portions 23*e* are joined to each other through brazing or soldering. The first segment 23*b* can be easily and reliably connected to the second segment 23*c* by joining the first joining portions 23*d* to each other and the second joining portions 23*e* to each other by brazing or soldering.

Figure 6:
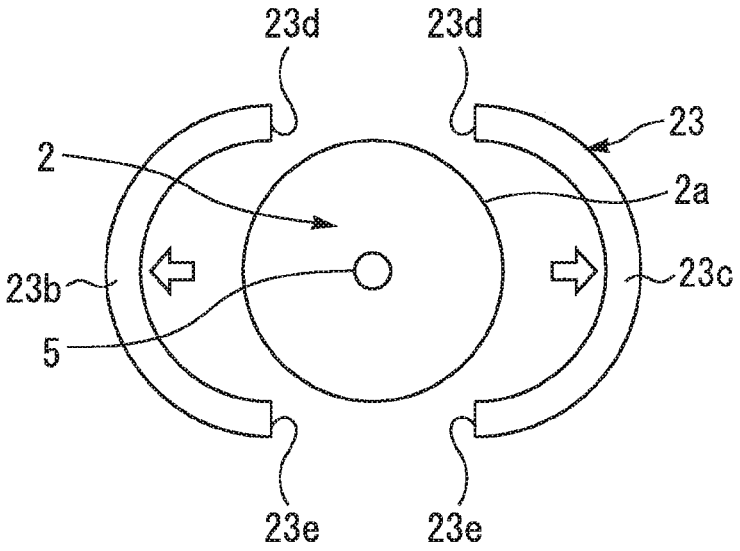
FIG. 6 is a plan view illustrating a state in which the shell heat exchanger is being replaced in Embodiment 1.

FIG. 6 is a plan view illustrating a state in which the shell heat exchanger 23 is being replaced in Embodiment 1. FIG. 6 is a view viewed from the axial direction of the shell 2*a* of the compressor 2. When the shell heat exchanger 23 needs to be replaced for a new shell heat exchanger, the first joining portions 23*d* and the second joining portions 23*e* of the shell heat exchanger 23 are separated as illustrated in FIG. 6. Each of the first segment 23*b* and the second segment 23*c* can be moved to the outer side of the shell 2*a* in the radial direction thereof and becomes removable by separating the first joining portions 23*d* from each other and the second joining portions 23*e* from each other. According to this embodiment, the following effect can be obtained by joining the first joining portions 23*d* to each other and the second joining portions 23*e* to each other by brazing or soldering. The first joining portions 23*d* can be easily separated from each other and the second joining portions 23*e* can be easily separated from each other by melting a brazing material or solder by heating the first joining portions 23*d* and the second joining portions 23*e*.

After removing the old first segment 23*b* and the old second segment 23*c* from the shell 2*a*, the new first segment 23*b* and the new second segment 23*c* are mounted on the shell 2*a*, and the first joining portions 23*d* are joined to each other and the second joining portions 23*e* are joined to each other by brazing or soldering.

According to this embodiment, the shell heat exchanger 23 can be easily replaced as above. As a result, the work cost for replacing the shell heat exchanger 23 can be reduced.

Figure 7:
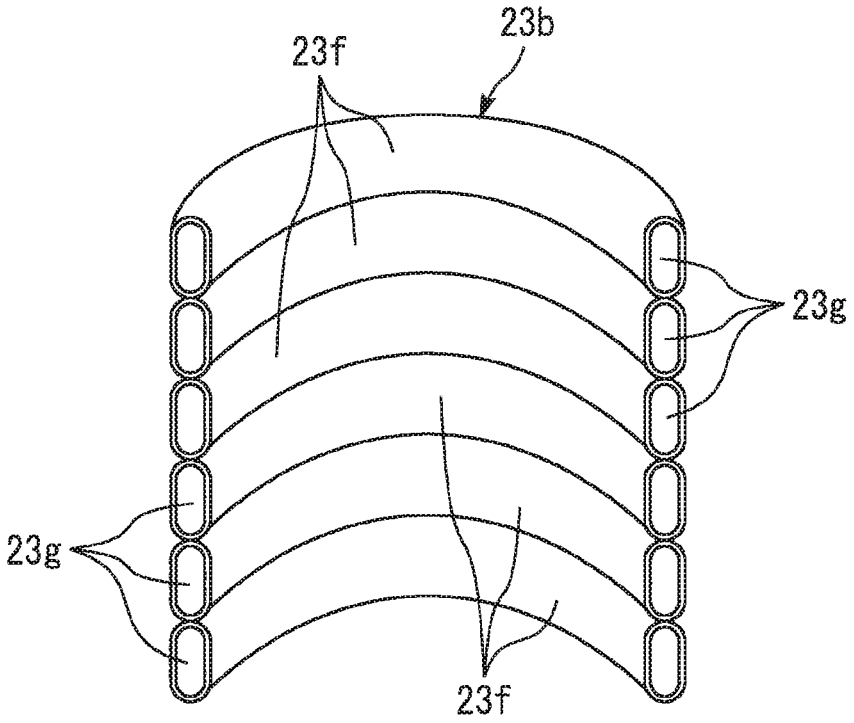
FIG. 7 is a perspective view of a first segment included in the shell heat exchanger of Embodiment 1.

FIG. 7 is a perspective view of the first segment 23*b* included in the shell heat exchanger 23 of Embodiment 1. As illustrated in FIG. 7, the first segment 23*b* includes a plurality of pipes 23*f* arranged in parallel with each other. Each of the pipes 23*f* curves in an arc-like shape. A flat surface may be formed on the inner side of the are of the pipe 23*f*. The contact area between the pipe 23*f* and the outer circumferential surface of the shell 2*a* can be increased, and the heat exchange efficiency can be increased by forming a flat surface on the inner side of the arc of the pipe 23*f*.

Each of the pipes 23*f* is fixed to the adjacent pipe 23*f*. Each of the pipes 23*f* may be welded to the adjacent pipe 23*f*.

The welding may be arc welding, TIG welding, or resistance welding. The following effect can be obtained when the adjacent pipes 23*f* are welded to each other. Even when the heat at the time of brazing or soldering the first joining portions 23*d* and the second joining portions 23*e* is conducted to the pipes 23*f*, the fixation between the adjacent pipes 23*f* can be reliably prevented from disengaging. Both ends of the first segment 23*b* have open ends 23*g* of the pipes 23*f*.

Figure 8:
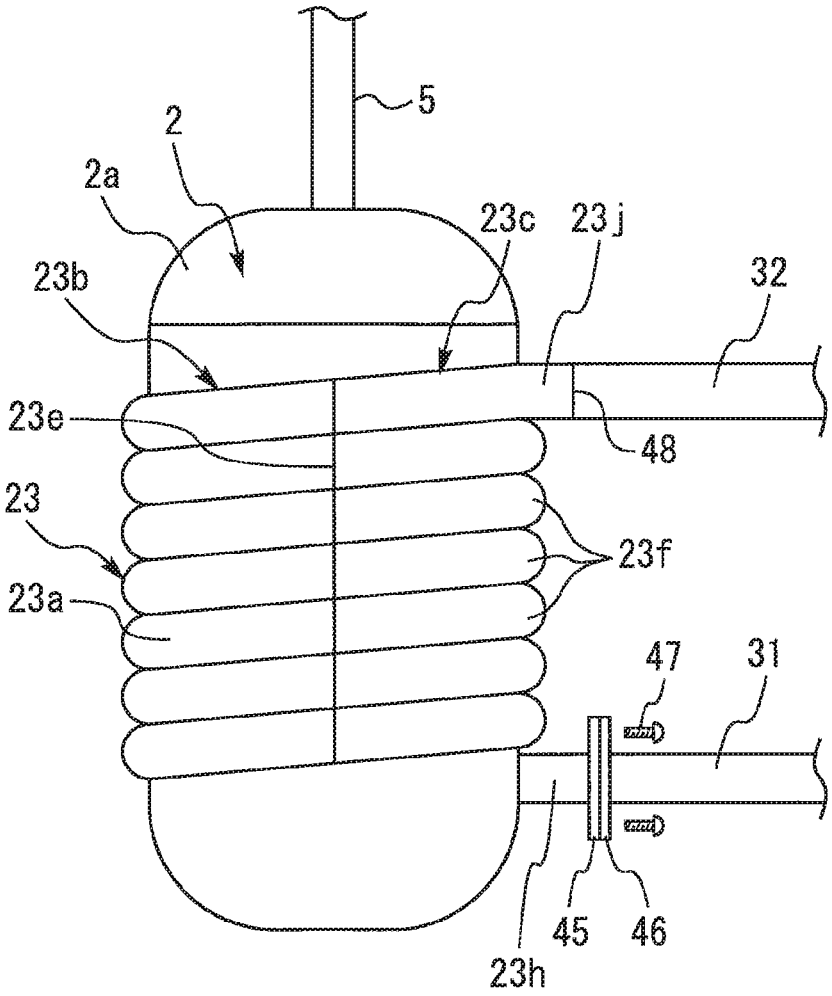
FIG. 8 is a side view of the compressor and the shell heat exchanger of Embodiment 1.

FIG. 8 is a side view of the compressor 2 and the shell heat exchanger 23 of Embodiment 1. As illustrated in FIG. 8, the second segment 23*c* of the shell heat exchanger 23 includes an inlet 23*h* and an outlet 23*j* of the shell heat exchanger 23. The second segment 23*c* has a similar structure as the first segment 23*b* other than including the inlet 23*h* and the outlet 23*j*. In the first joining portions 23*d* and the second joining portions 23*e*, the open ends 23*g* on both ends of the first segment 23*b* communicate with the open ends 23*g* on both ends of the second segment 23*c*. The flow paths in the plurality of pipes 23*f* included in the first segment 23*b* and the flow paths in the plurality of pipes 23*f* included in the second segment 23*c* are connected via the first joining portions 23*d* and the second joining portions 23*e* to form one flow path, whereby the helical conduit 23*a* is formed.

According to this embodiment, the following effects can be obtained. The manufacturing cost is low because the first segment 23*b* and the second segment 23*c* are manufactured with use of pipes. As a result, the manufacturing cost of the shell heat exchanger 23 can be reduced. In contrast to this, if a jacket shell heat exchanger in which sheet metals are combined is used, a combination of high-precision bending of sheet metal parts and the like is needed, and the parts manufacturing cost of the shell heat exchanger significantly increases.

According to this embodiment, the following effects can be obtained as a result of the shell heat exchanger 23 including the helical conduit 23*a*. The flow path of the heating medium in the shell heat exchanger 23 can become narrower and longer. The heat transfer coefficient can be increased without increasing pressure loss. The heat exchange efficiency of the shell heat exchanger 23 can be increased.

As illustrated in FIG. 8, a first member 45 is installed on an end portion of the inner pipe 31 through which the water, that is, the heating medium flows. The first member 45 may be a flange fixed to the end portion of the inner pipe 31. A second member 46 is installed on the inlet 23*h* of the shell heat exchanger 23. The second member 46 may be a flange fixed to the inlet 23*h*. The first member 45 and the second member 46 are mechanically connected to each other in a removable manner through screws 47. FIG. 8 illustrates a state in which the screws 47 are removed. The inner pipe 31 can be connected to the inlet 23*h* of the shell heat exchanger 23 by fastening the first member 45 and the second member 46 by the screws 47. The screw 47 is an example of a fastener. The fastener is not limited to the screws 47. The fastener may be a clip, that is, a metallic pinching part instead of the screw 47. The first member 45 may be in direct contact with the second member 46. Sealing materials such as a gasket or a packing may be sandwiched between the first member 45 and the second member 46.

According to this embodiment, the following effects can be obtained. When the shell heat exchanger 23 is replaced, the work for separating the old shell heat exchanger 23 from the inner pipe 31, and the work for connecting the new shell heat exchanger 23 to the inner pipe 31 can be easily performed. As a result, the work cost can be reduced.

As illustrated in FIG. 8, joining portions 48 between the end portion of the inner pipe 32 through which the water, that is, the heating medium flows and the outlet 23*j* of the shell heat exchanger 23 are joined to each other by brazing or soldering. When the shell heat exchanger 23 is replaced, the old shell heat exchanger 23 can be easily separated from the inner pipe 32 by melting a brazing material or solder melts by heating the joining portions 48. As a result, the work cost can be reduced.

The invention is not limited to the configurations described above, and may be configured as follows. The end portion of the inner pipe 31 may be joined to the inlet 23*h* of the shell heat exchanger 23 by brazing or soldering. The end portion of the inner pipe 32 may be mechanically connected to the outlet 23*j* of the shell heat exchanger 23 in a removable manner with use of a fastener such as a screw of a clip.

According to this embodiment described above, the heat pump apparatus 1 that is excellent in terms of energy efficiency, long-term reliability, product cost, and after-sale service cost can be obtained. Users are highly interested in the energy-saving-related functions of the heat pump apparatus 1, and the heat pump apparatus of the present invention makes a significant contribution.

In the embodiment described above, an example in which the shell heat exchanger 23 is separated into two segments, that is, the first segment 23*b* and the second segment 23*c* is described. The shell heat exchanger is not limited to such an example, and may be separated into three or more segments.

Embodiment 2

Now, Embodiment 2 is described with reference to FIG. 9 to FIG. 11, but the differences from Embodiment 1 described above are mainly described, and the description of the same parts or corresponding parts are simplified or omitted.

Figure 9:
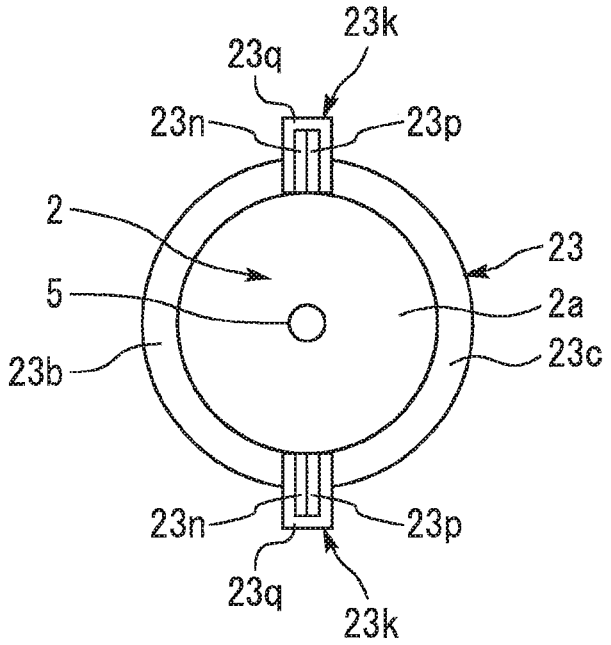
FIG. 9 is a plan view of a compressor and a shell heat exchanger included in a heat pump apparatus of Embodiment 2.
Figure 10:
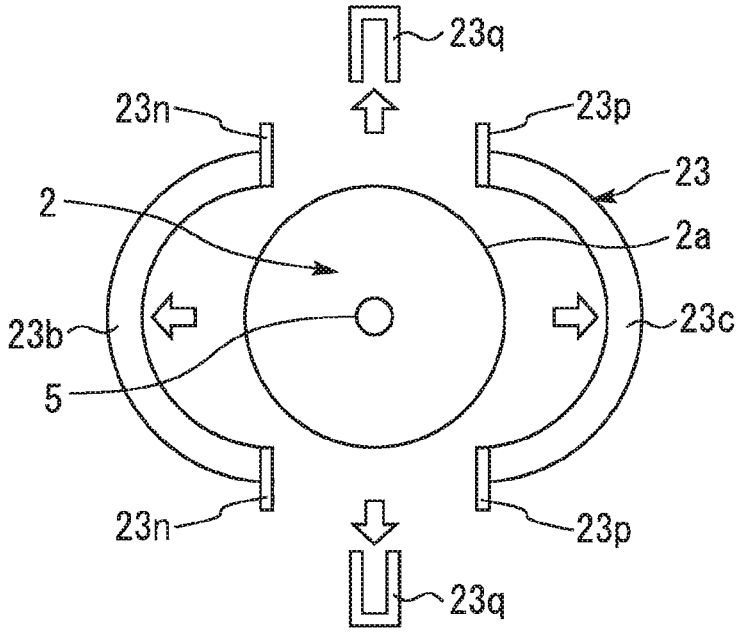
FIG. 10 is a plan view illustrating a state in which the shell heat exchanger is being replaced in Embodiment 2.

FIG. 9 is a plan view of the compressor 2 and the shell heat exchanger 23 included in the heat pump apparatus 1 of Embodiment 2. FIG. 10 is a plan view illustrating a state in which the shell heat exchanger 23 is being replaced in Embodiment 2. In FIG. 9 and FIG. 10, the illustration of the inlet and the outlet of the shell heat exchanger 23 is omitted.

As illustrated in these Figures, the shell heat exchanger 23 of Embodiment 2 includes a first joining portion 23*k* and a second joining portion 23*m* instead of the first joining portions 23*d* and the second joining portions 23*e* of Embodiment 1. The structure of the first joining portion 23*k* is described below. The second joining portion 23*m* has a structure similar to that of the first joining portion 23*k*, and hence the description of the second joining portion 23*m* is omitted.

The first joining portion 23*k* includes a first member 23*n* installed on the end portion of the first segment 23*b*, a second member 23*p* installed on the end portion of the second segment 23*c*, and a clip 23*q*. The first member 23*n* may be a plate-like member fixed to the end portion of the first segment 23*b*. The second member 23*p* may be a plate-like member fixed to the end portion of the second segment 23*c*. The first member 23*n* and the second member 23*p* are mechanically connected to each other in a removable manner through the clip 23*q*. The clip 23*q* is a metallic pinching part. The clip 23*q* is an example of a fastener. The fastener is not limited to the clip 23*q*. The fastener may be a screw instead of the clip 23*q*.

The first member 23*n* may be in direct contact with the second member 23*p*. Sealing materials such as a gasket or a packing may be sandwiched between the first member 23*n* and the second member 23*p*.

Figure 11:
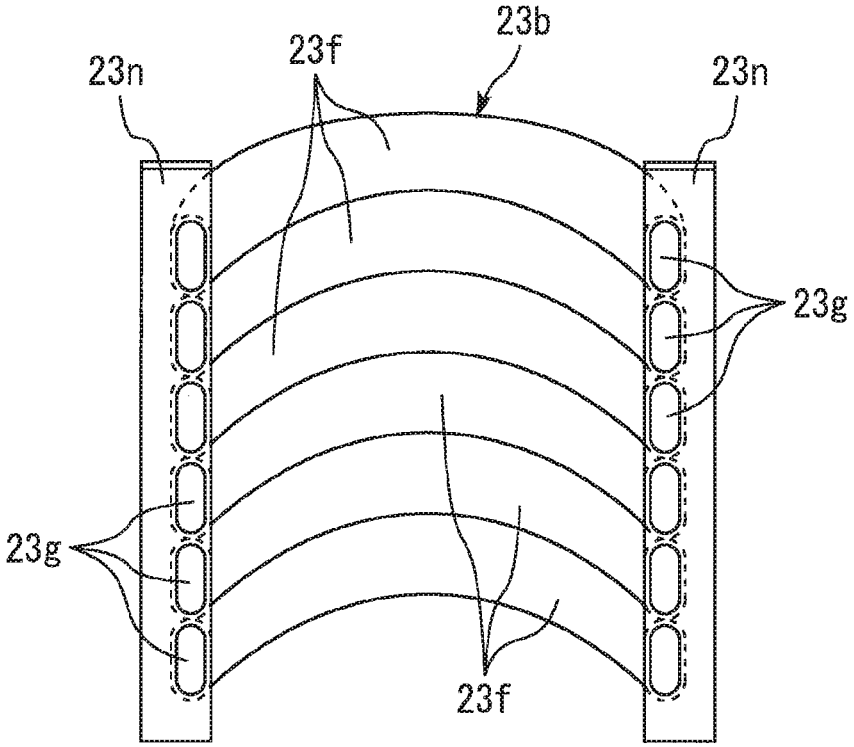
FIG. 11 is a perspective view of a first segment included in the shell heat exchanger of Embodiment 2.

FIG. 11 is a perspective view of the first segment 23*b* included in the shell heat exchanger 23 of Embodiment 2. As illustrated in FIG. 11, holes may be formed in the first member 23*n* at the same locations as the open ends 23*g* of the pipes 23*f* included in the first segment 23*b*. The open ends 23*g* of the pipes 23*f* may be fixed to the first member 23*n*. The first member 23*n* may have a function of integrally supporting the plurality of pipes 23*f*. The second member 23*p* may have the same or similar structure as the first member 23*n*. The second segment 23*c* has a similar structure as the first segment 23*b* other than having an inlet and an outlet. As a result, the perspective view of the second segment 23*c* is omitted.

According to this embodiment, the following effects can be obtained. The first joining portion 23*k* and the second joining portion 23*m* can be easily separated by removing the clip 23*q* when the shell heat exchanger 23 is replaced. Each of the first segment 23*b* and the second segment 23*c* becomes removable to the outer side of the shell 2*a* in the radial direction thereof. As a result, an effect similar to that of Embodiment 1 can be obtained. There is no need for brazing or soldering, and hence the work cost can be even more reduced as compared to Embodiment 1.

Embodiment 3

Now, Embodiment 3 is described with reference to FIG. 12 and FIG. 13, but the differences from Embodiment 2 described above are mainly described, and the description of the same parts or corresponding parts are simplified or omitted.

Figure 12:
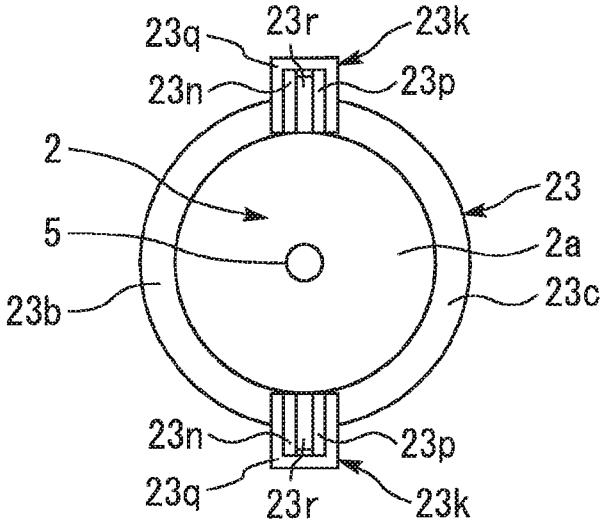
FIG. 12 is a plan view of a compressor and a shell heat exchanger included in a heat pump apparatus of Embodiment 3.
Figure 13:
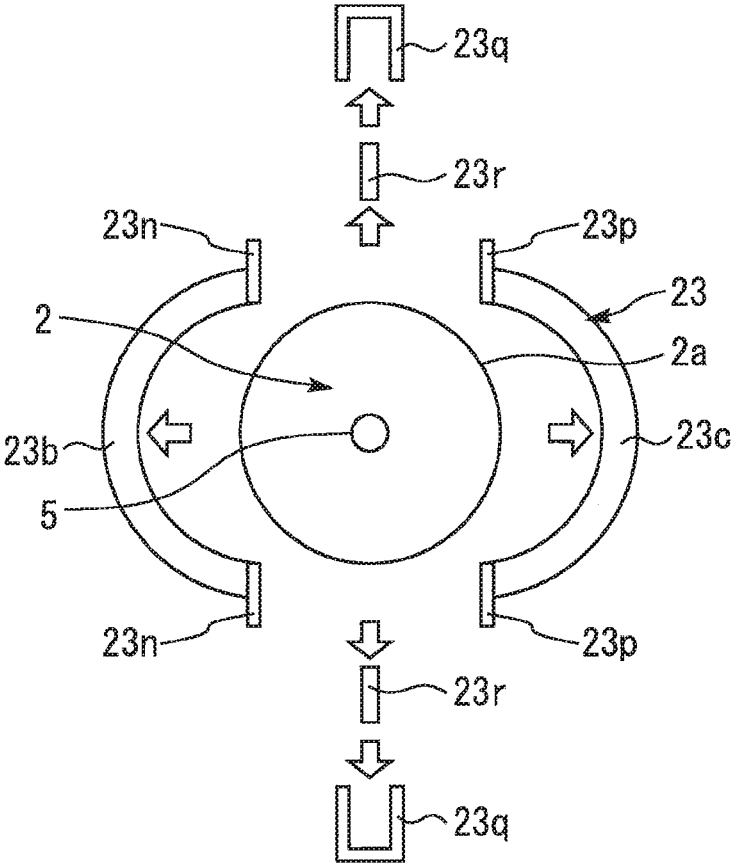
FIG. 13 is a plan view illustrating a state in which the shell heat exchanger is being replaced in Embodiment 3.

FIG. 12 is a plan view of the compressor 2 and the shell heat exchanger 23 included in the heat pump apparatus 1 of Embodiment 3. FIG. 13 is a plan view illustrating a state in which the shell heat exchanger 23 is being replaced in Embodiment 3. In FIG. 12 and FIG. 13, the illustration of the inlet and the outlet of the shell heat exchanger 23 is omitted.

As illustrated in these Figures, the first joining portion 23*k* of the shell heat exchanger 23 of Embodiment 3 has the same configuration as the first joining portion 23*k* of Embodiment 2 except for further including an elastic member 23*r* between the first member 23*n* and the second member 23*p*. The structure of the first joining portion 23*k* of Embodiment 3 is described below. The second joining portion 23*m* has a structure similar to that of the first joining portion 23*k*, and hence the description of the second joining portion 23*m* is omitted.

The elastic member 23*r* is sandwiched between the first member 23*n* and the second member 23*p* and is compressed. The distance between the first member 23*n* and the second member 23*p* can be changed by elastically deforming the elastic member 23*r*. The elastic member 23*r* is at least partially made of elastic materials such as rubber, elastomer, and resin. The elastic modulus of the elastic member 23*r* is lower than the elastic modulus of the conduit 23*a* of the shell heat exchanger 23.

According to this embodiment, the following effects can be obtained.

(First effect) When the first member 23*n* and the second member 23*p* are connected to each other by a fastener such as the clip 23*q* when the shell heat exchanger 23 is mounted, the distance between the first member 23*n* and the second member 23*p* is adjusted by the defoamation of the elastic member 23*r*. As a result, the inner circumferential surfaces of the first segment 23*b* and the second segment 23*c* can be placed in close contact with the outer circumferential surface of the shell 2*a* more reliably. As a result, the heat resistance between the shell 2*a* and the shell heat exchanger 23 can be reliably reduced. The inner circumferential surfaces of the first segment 23*b* and the second segment 23*c* can be reliably placed in close contact with the outer circumferential surface of the shell 2*a* without excessively increasing the part accuracy and the assembly accuracy.

(Second effect) The compressor 2 vibrates when the heat pump apparatus 1 is in operation. The vibration is transmitted to the shell heat exchanger 23, the inner pipe 31, the water/refrigerant heat exchanger 8, and the base 17 in the stated order, and is transmitted to the parts of the casing. The vibration of the compressor 2 is transmitted to the shell heat exchanger 23, the inner pipe 32, the hot water outlet valve 29, and the right-side portion of the base 17 in the stated order, and is transmitted to the parts of the casing. As described above, there is a possibility that the vibration is transmitted to the parts of the casing, and the heat pump apparatus 1 generates vibration, low frequency sound, and noise. There is a possibility that the inner pipe 31 and the inner pipe 32 need to have high strength in order to prevent the inner pipe 31 and the inner pipe 32 from breaking. According to this embodiment, the vibration of the compressor 2 can be absorbed and attenuated by the elastic member 23*r*. As a result, the vibration transmitted to the parts of the casing can be reduced. The vibration, the low frequency sound, and the noise generated by the heat pump apparatus 1 can be decreased. The inner pipe 31 and the inner pipe 32 do not necessarily need to have extremely high strength.

An elastic member may be sandwiched between the first member 45 and the second member 46 in FIG. 8. In this way, an effect similar to the abovementioned second effect can be obtained.

The methods for joining the plurality of joining portions between the segments of the shell heat exchanger 23 do not need to be unified. For example, two or more of the joining portions of Embodiment 1, the joining portions of Embodiment 2, and the joining portions of Embodiment 3 may be mixed in the plurality of joining portions included in the shell heat exchanger 23.

REFERENCE SIGNS LIST

1 Heat pump apparatus
2 Compressor
2*a* Shell
4 Suction pipe
5 Discharge pipe
6 Fan
7 Air/refrigerant heat exchanger
8 Water/refrigerant heat exchanger
9 Electrical item accommodation box
9*a* Terminal block
10 Expansion valve
12 Accommodation container
14 Machine room
15 Fan chamber
16 Partition plate
17 Base
18 Casing front-surface portion
18*a* Grating
19 Casing rear-surface portion
20 Casing upper-surface portion

21 Casing right side-surface portion
22 Casing left side-surface portion
23 Shell heat exchanger
23*a* Conduit
23*b* First segment
23*c* Second segment
23*d* First joining portion
23*e* Second joining portion
23*f* Pipe, 23*g* Open end
23*h* Inlet, 23*j* Outlet
23*k* First joining portion
23*m* Second joining portion
23*n* First member
23*p* Second member
23*q* Clip
23*r* Elastic member
24 Electronic substrate
27 Service panel
28 Water inlet valve
29 Hot water outlet valve
30, 31, 32 Inner pipe
33 Hot water storage apparatus
34 Hot water storage tank
35 Water pump
36, 37 External pipe
38, 39 Pipe
40 Mixing valve
41 Hot water supply pipe
42 Water supply pipe
43 Hot water supply pipe
44 Water supply pipe
45 First member
46 Second member
47 Screw
48 Joining portion

The invention claimed is:

1. A heat pump apparatus, comprising:
a compressor including a cylindrical shell, the compressor being configured to compress a refrigerant; and
a shell heat exchanger including a helical conduit wound around an outer circumference of the cylindrical shell, the shell heat exchanger being configured to transfer heat of the cylindrical shell to a heating medium flowing through the conduit, wherein:
the shell heat exchanger includes:
a plurality of segments; and
joining portions configured to connect end portions of adjacent segments;
the segments each at least partially have an arc-like shape along the outer circumference of the cylindrical shell when viewed from an axial direction of the cylindrical shell;
the segments are removable in a radial direction of the cylindrical shell when the joining portions are separated; and
the segments each include a plurality of arc-like shaped pipes in parallel with each other,
wherein each of the arc-like shaped pipes comprises an outer surface, and in a state of the segments being removed from the cylindrical shell each outer surface is in direct fixed contact to a respective at least one other outer surface of the arc-like shaped pipes.

2. The heat pump apparatus according to claim 1, wherein at least one of the joining portions is in a joined state by brazing or soldering.

3. The heat pump apparatus according to claim 1, wherein at least one of the joining portions is in a removably connected state with use of a fastener.

4. The heat pump apparatus according to claim 1, further comprising a pipe through which the heating medium flows,
wherein an end portion of the pipe is joined to an inlet or an outlet of the shell heat exchanger by brazing or soldering.

5. The heat pump apparatus according to claim 1, further comprising a pipe through which the heating medium flows,
wherein an end portion of the pipe is removably connected to an inlet or an outlet of the shell heat exchanger with use of a fastener.

6. The heat pump apparatus according to claim 1, wherein at least one of the joining portions includes:
a first member installed on an end portion of one of the segments;
a second member installed on an end portion of another one of the segments; and
a fastener configured to removably connect the first member and the second member to each other.

7. The heat pump apparatus according to claim 1, further comprising:
a pipe through which the heating medium flows;
a first member installed on an end portion of the pipe;
a second member fixed to an inlet or an outlet of the shell heat exchanger; and
a fastener configured to removably connect the first member and the second member to each other.

8. The heat pump apparatus according to claim 6, further comprising an elastic member between the first member and the second member.

9. The heat pump apparatus according to claim 1, wherein:
the segments each have, on end portions thereof, open ends of the plurality of arc-like shaped pipes; and
the open ends of one of adjacent segments and the open ends of the other of the adjacent segments communicate with each other through the joining portions.

* * * * *